US006941578B2

(12) United States Patent
Anderson

(10) Patent No.: US 6,941,578 B2
(45) Date of Patent: Sep. 13, 2005

(54) GLOVE CLOSURE APPARATUS

(75) Inventor: James Trevor Anderson, Berkeley, CA (US)

(73) Assignee: Jas. D. Easton, Inc., Van Nuys, CA (US)

( * ) Notice: Subject to any disclaimer, the term of this patent is extended or adjusted under 35 U.S.C. 154(b) by 7 days.

(21) Appl. No.: 10/429,540

(22) Filed: May 3, 2003

(65) Prior Publication Data

US 2004/0216207 A1 Nov. 4, 2004

(51) Int. Cl.[7] ..... A41D 13/08
(52) U.S. Cl. ..... 2/19
(58) Field of Search ..... 2/19, 161.1, 18, 2/20, 159, 161.6, 161.5, 169; 473/458

(56) References Cited

U.S. PATENT DOCUMENTS 5,253,365 A * 10/1993 Clevenhagen ..... 2/19
5,694,641 A * 12/1997 Doi et al. ..... 2/19
5,799,327 A * 9/1998 Clevenhagen ..... 2/19
6,182,289 B1 * 2/2001 Brown ..... 2/19
6,370,691 B2 * 4/2002 Park ..... 2/19

* cited by examiner

*Primary Examiner*—Gary L. Welch
(74) *Attorney, Agent, or Firm*—Holland & Hart

(57) ABSTRACT

A glove that includes a glove closure apparatus in the form of a closure channel that allows the glove to be more easily closed or compressed without requiring extensive breaking-in procedures. In one embodiment the glove includes one or more closure channels near the palm portion of the front side of the glove. The closure channels are U-shaped closure channels or gaps that allow the glove to be compressed significantly easier than if the material were otherwise in the channel area. A plurality of closure channels may be formed at specific locations on the front side of the glove to reduce the amount of force that is required to close and open the glove. In addition, the one or more closure channels may include a cover material to prevent debris from entering into an interior region of the glove.

29 Claims, 3 Drawing Sheets

GLOVE CLOSURE APPARATUS

FIELD OF THE INVENTION

This invention relates to gloves, and more particularly to gloves for sporting activities such as baseball and softball.

BACKGROUND OF THE INVENTION

Various sports require the use of a glove by the participants to catch a ball during play. A glove is generally a device that fits over the entire hand of an individual so the individual can catch the ball to minimize if not avoid pain, and to assist in grasping the ball. A glove generally comprises a thumb stall and one or more finger stalls such that an individual's thumb and fingers can fit within the stalls. The thumb and finger stalls allow a user to compress, fold, or pinch the glove, similar to the manner in which an individual would close his or her hand around an object. This folding of the glove allows a user to catch a ball inside the glove and prevent it from falling to the ground. To reliably catch a ball with a glove, a user must compress the glove around the ball when the ball is within the pocket of the glove.

One of the problems often associated with gloves, particularly new gloves, is their stiffness and difficulty to close and to compress around a ball. Traditional gloves made of leather may take many weeks to break in, even when frequently used. Gloves made of synthetic materials are usually not quite as stiff, but break-in problems nevertheless remain. Glove stiffness is particularly problematic for younger individuals who do not have sufficient hand strength to compress the glove in its initial stiff state.

Various measures have traditionally been used to speed up the breaking-in process and break down the initial stiffness of a glove. Some traditional techniques include oiling the glove to loosen up the material and placing the glove between a mattress and bed spring, perhaps, even with a ball in the pocket, for a particular duration of time. Still other devices have been developed that maintain a new glove in a closed position around a ball when not in use to assist the break-in process. Although these prior techniques may be able to speed up the break-in process, they require significant amounts of time. During such a break-in time, the force necessary to compress the glove decreases very slowly. Moreover, the problem remains that a user of a new glove cannot immediately and effectively use the glove in competition.

Therefore, there is a need for a glove that includes a closure apparatus to assist a user of the glove to compress or close the glove. There is also a need to minimize the amount of force required to effectively use the glove from the outset. In addition, there is a need for a glove closure apparatus that eliminates the need for additional procedures to be performed to break in the glove.

SUMMARY OF THE INVENTION

The present invention involves a glove closure device that makes a glove used in various sporting activities such as, without limitation, baseball and softball, easy to compress without requiring extensive breaking-in procedures. The glove closure device comprises one or more closure channels formed in the palm portion of the front side of the glove. The closure channels are generally U-shaped closure channels, notches, or gaps that allow the glove to be easily closed or compressed. The closure channels are devoid of material, such as leather, that forms the front side or front ply of the glove. Such material would otherwise be at a critical location and would need to be broken in before the glove could be used effectively. Therefore, individuals who do not possess the requisite hand strength to compress conventional, new gloves can immediately utilize the glove of the present invention to catch effectively. The closure channels are preferably positioned at specific locations (i.e., at typical hinge locations on the glove) to reduce the amount of force required to compress the glove with the finger stalls, the thumb stall, or a combination of the finger stalls and thumb stall. In one embodiment, the closure channels may be covered with a mesh or other suitable material to prevent debris or other foreign material from entering into an interior region of the glove.

One embodiment of a glove in accordance with the present invention may comprise a single closure channel formed in the palm on the front side of the glove between the thumb stall and hand receiving opening. The closure channel is generally a U-shaped closure channel to facilitate compressing, folding, or hinging the glove at the closure channel area, specifically about the convergence point of the "U." The position of this closure channel allows a user to compress the glove using primarily a thumb that urges the thumb stall toward the finger stalls. Certain glove users prefer to catch a ball by articulating their thumbs toward the palms of their hand, rather than articulating their fingers toward their thumbs.

Another embodiment of a glove in accordance with the present invention may comprise two or more closure channels formed in the palm of the front side of the glove such that the plurality of closure channels collectively reduce the amount of force necessary to compress the glove while catching a ball. The closure channels are generally U-shaped such that the glove can easily be compressed, folded, or hinged about the convergence point of the "U." One of the closure channels may be formed in the palm of the front ply between the thumb stall and hand receiving opening. Another of the closure channels may be formed in the palm of the front ply between one of the finger stalls and the hand receiving opening.

Still another embodiment of the glove in accordance with the present invention comprises a closure channel with a mesh or other cover material extending between or spanning the closure channel area. The mesh or other material prevents debris from entering into an interior region of the glove, yet the material does not require any extensive break-in period to be fully functional.

The foregoing and other features, utilities, and advantages of the invention will be apparent from the following detailed description of the invention with reference to the accompanying drawings.

DETAILED DESCRIPTION OF THE INVENTION

Reference will now be made to the drawings to describe presently preferred embodiments of the invention. Those skilled in the art will understand that the drawings are diagrammatic and schematic representations of the presently preferred embodiments, and should not be construed to limit the present invention.

The present invention relates to a glove closure apparatus for gloves used in sporting activities requiring a ball or similar object, such as without limitation baseball and softball. The novel closure apparatus allows a glove to be easily compressed or hinged without requiring extensive breaking-in procedures. The glove closure apparatus comprises one or more closure channels in the palm portion of the front side or front ply of the glove. The closure channels are generally U-shaped closure channels, notches, or gaps that allow the glove to be compressed, folded, or hinged significantly easier than if solid material otherwise remained in the U-shaped closure channel areas. The closure channels allow individuals, particularly those who do not possess superior hand strength, to compress effectively a conventional, new, non-broken-in glove. The closure channels allow a person to immediately utilize the glove without an extensive break-in period. The closure channels are formed in the glove at specific locations that correspond to typical hinge or fold locations on a glove to reduce the amount of force required to compress the glove using fingers, a thumb, or combination of the thumb and fingers. In one embodiment, the closure channels may include a mesh or other suitable material to prevent debris from entering into an inside region of the glove. Also, while embodiments of the present invention are shown and described in the context of a baseball or softball fielder's glove, it will be appreciated that the teachings of the present invention are applicable to other applications as well. For example, the teachings of the present invention could be applied to other types of baseball and softball gloves, including but not limited to first baseman's gloves, and catcher's gloves. Still further, the invention can be incorporated into gloves used in other sports, such as without limitation gloves used by hockey goalies.

Figure 1:
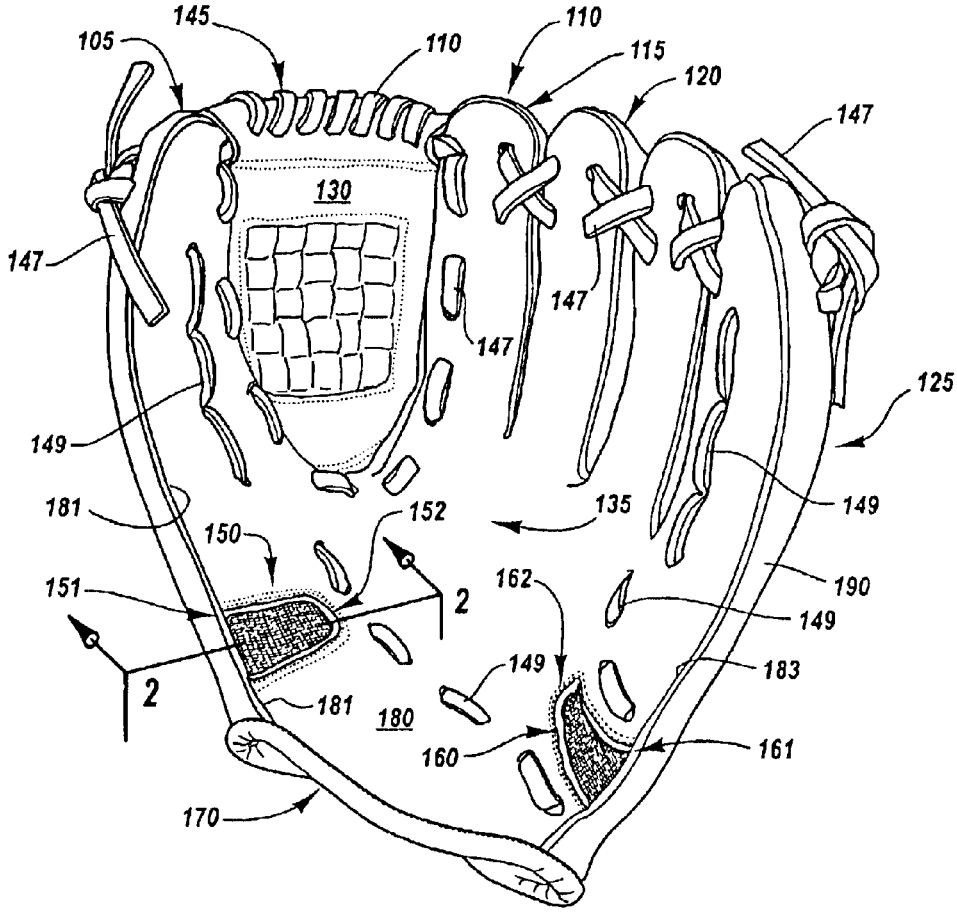
FIG. 1 is a perspective view of a glove having two closure channels formed in the front side of the glove according to the present invention.

FIG. 1 shows a glove 100 in accordance with the present invention. Generally, the glove 100 comprises a front side or front ply 180 and a back side or back ply 190. A lacing system 145 is used to secure parts of the glove together in a conventional manner. The front and back sides 180, 190 are formed of material, such as leather or another suitable material, shaped in the form of a glove so as to include finger stalls, a thumb stall, and a palm area 135. The front side 180 and back side 190 form the outer surfaces of the glove. The front and back sides 180, 190, together form an opening 170 to receive an individual's hand.

The glove 100 further comprises a thumb stall 105 for receiving an individual's thumb, four finger stalls 110, 115, 120, 125 for receiving an individual's fingers, and a palm 135 area which corresponds to the palm area of an individual's hand and forms the so-called pocket of the glove 100. Therefore, the user's hand can be inserted through the hand receiving opening 170 and positioned appropriately so that the palm area 135 corresponds to the user's palm of hand, and so that the user's thumb and fingers fill, respectively, the thumb stall 105 and finger stalls 110, 115, 120, 125.

The lacing system 145 comprises one or more laces 147 made of leather or any other suitable material that extend through a series of eyelets to secure the glove together in a conventional manner. The leather laces 147 secure the finger stalls 110, 115, 120, 125 to one another and secure a web 130 between the thumb stall 105 and the index finger stall 110. The web 130 prevents the ball from slipping between the thumb stall 105 and index finger stall 110 of the glove 100 during a catch in a conventional manner. Any type of web may be incorporated into the glove. The leather laces 147 may comprise leather or another suitable material to allow for durability and flexibility. The lacing system 145 further includes a stitch 149 that joins, in part, the front and back sides 180, 190 together, and holds certain glove insert material (not shown) in desired locations. Any conventional lacing system may be used.

The illustrated embodiment of the glove 100 comprises a closure apparatus in the form of a plurality of closure channels 150, 160 to minimize the force necessary to compress or hinge the glove. The closure channels 150, 160 enhance the flexibility of the glove and are positioned in the palm 135 of the front side or ply 180 of the glove. The closure channels comprise wide, open ends 151, 161 respectively, that terminate at respective outer edges 181, 183 of the front side 180 of the glove. The closure channels 150, 160 converge toward respective apex locations 152, 162 inward of the outer edges 181, 183 of the glove. The left closure channel 150 is positioned between the thumb stall 105 and the hand receiving opening 170. The right closure channel 160 is formed in the front ply 180 between the pinky finger stall 125 and the hand receiving opening 170. The closure channels 150, 160 are substantially U-shaped closure channels. The open closure channels 150, 160 allow the glove to be compressed or folded easier than if a piece of solid glove material otherwise remained in the closure channel area.

Figure 2:
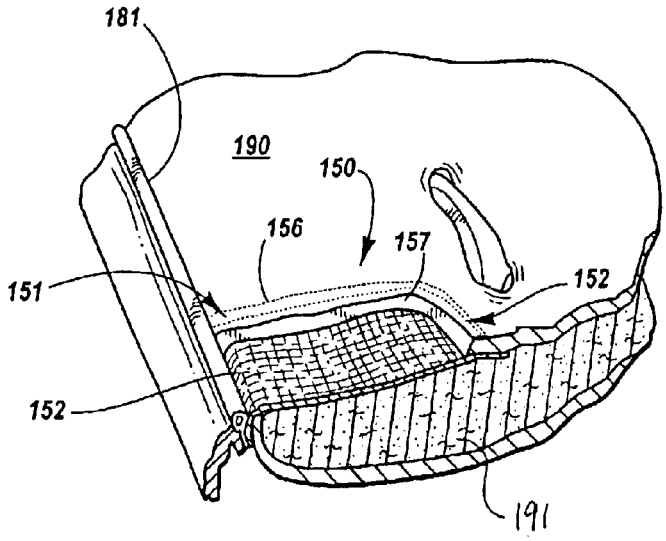
FIG. 2 is a cutaway view of one of the glove channels of FIG. 1.

As shown in FIG. 2, the left or thumb closure channel 150 (which has the same structure as closure channel 160) further comprises a cover material 152 that may comprise mesh, neoprene, nylon, or any other suitable material that has a substantially less resistance to bending as compared to leather or other glove material. The cover material extends between or spans the closure channel 150 and is attached to the bottom of an exposed edge 157 of the front side 180. Cover material 152 may be a breathable material, and is designed to be readily flexible so that no break in of the cover material is required. Cover material 152 also prevents debris from entering into an interior region of the glove where padding material 191 may be present. The cover material 152 is secured to the front side 180 by stitching 156. The closure channel 150 across which mesh material 152 extends is defined by the exposed edge 157 of the front side 180. As mentioned, the right or finger closure channel 160 is constructed similarly to closure channel 150. A cover material 162 spans the closure channel 160.

The fundamental compression functionality of the closure channels 150, 160 is provided by eliminating the rigid material in the closure channel area of the front side 180. Also, debris is prevented from entering an interior region of the glove.

Figure 3:
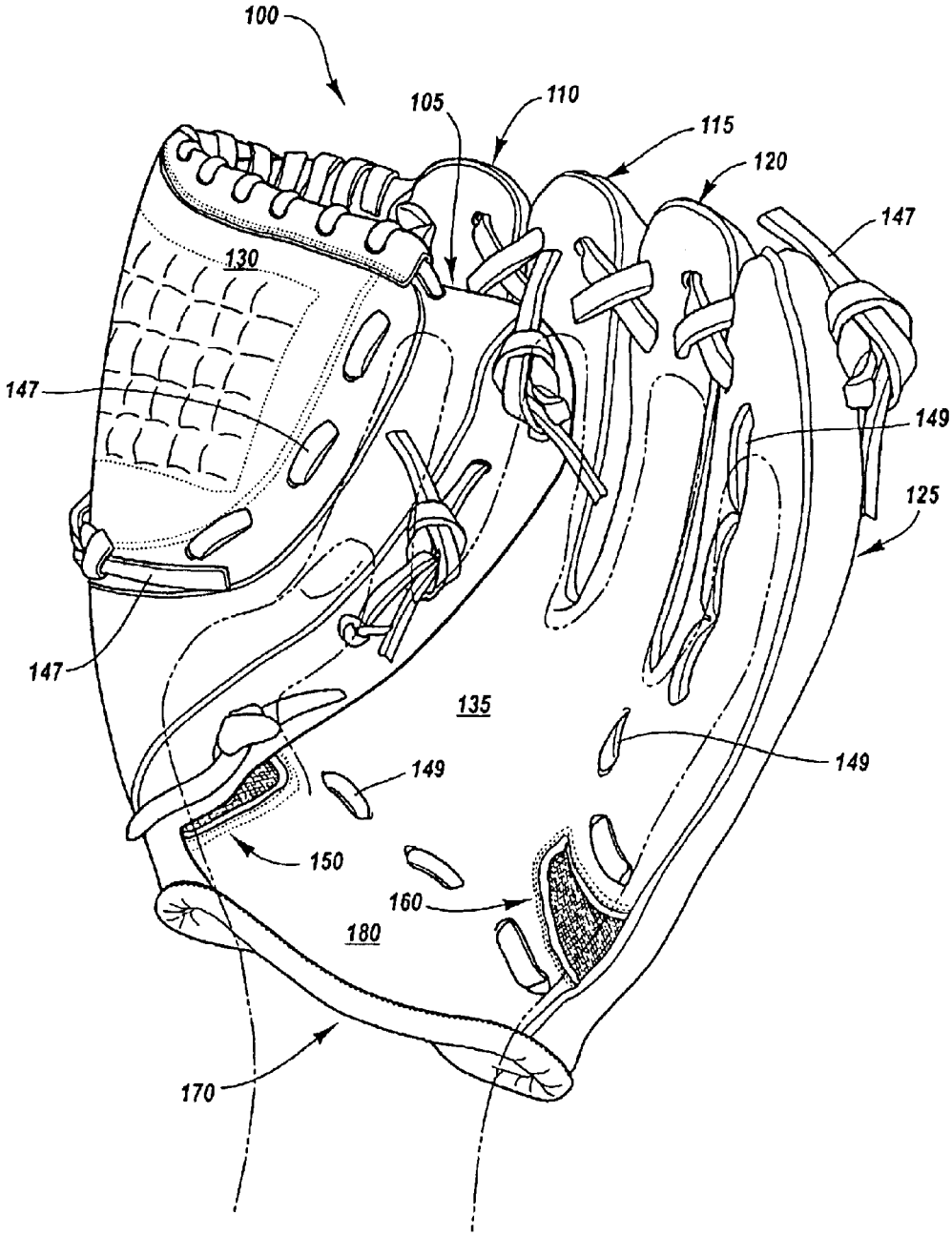
FIG. 3 is a perspective view, with a user's hand shown in phantom, of the glove illustrated in FIG. 1, with the glove being compressed at one of the closure channels adjacent the thumb stall.
Figure 4:
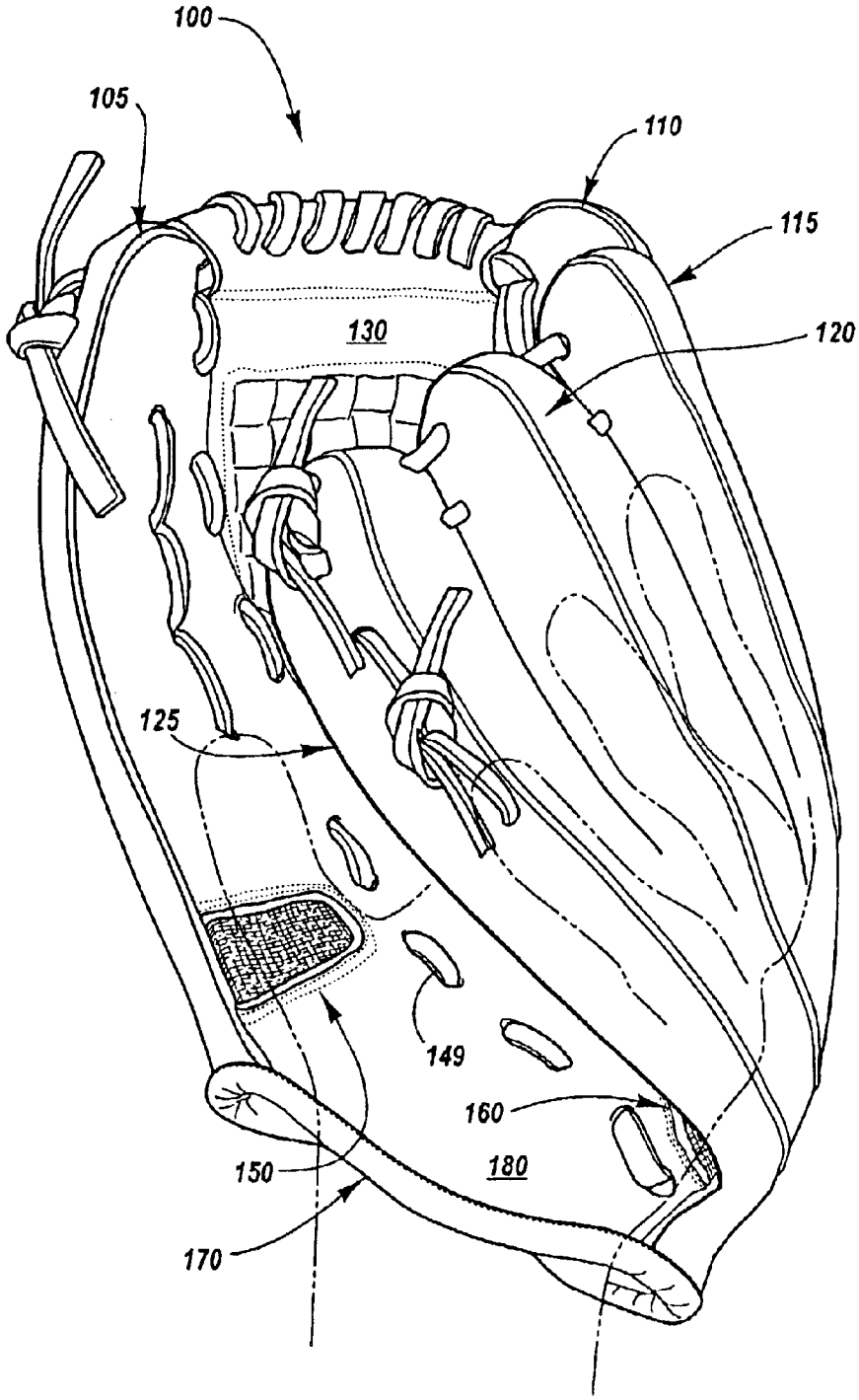
FIG. 4 is a perspective view, with a user's hand shown in phantom, of the glove illustrated in FIG. 1, with the glove being compressed at one of the closure channels adjacent one of the finger stalls.

With reference to FIGS. 3 and 4, the closure channels 150, 160 are positioned at particular locations in the palm 135 corresponding to typical hinge locations on a glove 100. The closure channels provide additional compressibility without removing an unnecessarily large amount of material from the front side 180 of the glove. If too much material is removed from the glove to provide increased compressibility, an overall reduction in the glove's performance may result. Therefore, the size and shape of the closure channels 150, 160 are optimized to provide enhanced flexibility without substantially affecting the glove's fundamental functions.

FIG. 3 shows the left closure channel 150 positioned to facilitate hinging of the glove adjacent the thumb stall 105. Certain users prefer to close the glove by compressing or articulating their thumbs towards their fingers, as shown in FIG. 3. By positioning the left closure channel 150 in the location shown, the left portion of the glove 100 including the thumb stall 105 is more easily able to fold toward the right portion of the glove 100 (i.e., finger stalls 110, 115, 120, 125). In FIG. 3, the fold line between the left and right portions of the glove 100 extends from the apex of the left closure channel 150 toward the web 130.

FIG. 4 shows the right closure channel 160 positioned to facilitate hinging of the glove adjacent finger stalls 110, 115, 120, 125. Often users prefer to close the glove by compressing their fingers towards their thumb, as shown in FIG. 4. By positioning the right closure channel 160 in the location shown, the right portion of the glove 100, including the finger stalls 110, 115, 120, 125, can more easily be hinged or articulated toward the left portion of the glove (i.e., toward the thumb stall 105). In FIG. 4, the fold line between the left and right portions of the glove 100 extends from the right closure channel 160 and up through pocket area 135 and toward the web 130.

It should be understood that both closure channels 150, 160 may be used simultaneously, depending on the user, to aid in closing the glove.

While this invention has been described with reference to certain specific embodiments and examples, it will be recognized by those skilled in the art that many variations are possible without departing from the scope and spirit of this invention. The invention, as defined by the claims, is intended to cover all changes and modifications of the invention which do not depart from the spirit of the invention. The words "including" and "having," as used in the specification, including the claims, shall have the same meaning as the word "comprising".

What is claimed is:

1. A glove closure apparatus, comprising:

a glove comprising a front side and a back side, the glove further comprising a thumb stall, at least one finger stall, and an opening for receiving a person's hand;

a plurality of closure channels formed exclusively in the front side of the glove to assist the person in opening and closing the glove.

2. A glove closure apparatus according to claim 1 wherein one of the plurality of closure channels is formed adjacent the thumb stall.

3. A glove closure apparatus according to claim 1 wherein one of the plurality of closure channels is formed adjacent the thumb stall and another of the plurality of closure channels is formed adjacent the at least one finger stall.

4. A glove closure apparatus according to claim 1 wherein one of the plurality of closure channels is formed adjacent the at least one finger stall.

5. A glove closure apparatus according to claim 1 wherein the plurality of closure channels are U-shaped closure channels.

6. A glove closure apparatus according to claim 1 wherein the plurality of closure channels comprises exactly two closure channels.

7. A glove closure apparatus according to claim 1 wherein each closure channel comprises a wide end adjacent an outer edge of the front side of the glove and an apex location inward of the outer edge of the glove.

8. A glove closure apparatus according to claim 1 wherein each closure channel is covered by a cover material to prevent debris from entering into an interior area of the glove.

9. A glove closure apparatus according to claim 1 wherein at least two of the plurality of closure channels are located on opposite sides of the opening for receiving the person's hand.

10. A glove closure apparatus according to claim 1 wherein one of the plurality of closure channels is disposed between the thumb stall and the opening for receiving the person's hand.

11. A glove closure apparatus, comprising:

a glove;

a front side forming a palm of the glove, wherein the palm of the glove comprises a closure channel for assisting in closing the glove;

a thumb stall, a finger stall, and a hand receiving opening;

wherein the closure channel is disposed between the thumb stall and the hand receiving opening.

12. A glove closure apparatus according to claim 11 wherein the front side and back side comprise leather.

13. A glove closure apparatus according to claim 11 wherein the closure channel is a U-shaped closure channel.

14. A glove closure apparatus according to claim 11 wherein a web is disposed between the thumb stall and the finger stall.

15. A glove closure apparatus according to claim 11 wherein the glove is an open back glove.

16. A glove closure apparatus according to claim 11 wherein the lacing system includes a leather lace extending through a plurality of eyelets in the front side.

17. A glove closure apparatus according to claim 11 wherein the glove further includes a hand retention strap adjacent to the hand receiving opening.

18. A glove closure apparatus according to claim 11, further comprising a cover material that spans the closure channel.

19. A glove closure apparatus, comprising:

a glove;

a front side forming a palm of the glove;

a back side having an interior and an exterior surface forming a back ply of the glove a closure channel formed in the front side and exposing the interior surface of the back ply to assist in opening and closing the glove;

a cover material spanning the closure channel.

20. A glove closure apparatus according to claim 19 wherein the glove further comprises a thumb stall, at least one finger stall, and a hand receiving opening.

21. A glove closure apparatus according to claim 19 wherein the glove further includes a thumb stall, four finger stalls, and a hand receiving opening.

22. A glove closure apparatus according to claim 19 wherein the front side comprises leather.

23. A glove closure apparatus according to claim 19 wherein the closure channel is U-shaped.

24. A glove closure apparatus according to claim 19 wherein the cover material that spans the closure channel prevents foreign debris from entering an inside area of the glove.

25. A glove closure apparatus according to claim 19 wherein the glove further comprises a thumb stall, at least one finger stall, and a hand receiving opening, and a web secured between the thumb stall and the at least one finger stall.

26. A glove closure apparatus according to claim 19 wherein the glove is an open back glove.

27. A glove closure apparatus according to claim 19, further comprising a lacing system.

28. A glove closure apparatus according to claim 19, further comprising a pair of closure channels.

29. A glove closure apparatus according to claim 19, further comprising a pair of closure channels, wherein one of the closure channels is disposed between the thumb stall and a hand receiving opening.

* * * * *